US008278539B1

(12) United States Patent
Botz

(10) Patent No.: US 8,278,539 B1
(45) Date of Patent: Oct. 2, 2012

(54) SPOOL MOUNT FOR INSTRUMENT STRINGS

(76) Inventor: Jason Botz, Flint, MI (US)

( * ) Notice: Subject to any disclaimer, the term of this patent is extended or adjusted under 35 U.S.C. 154(b) by 0 days.

(21) Appl. No.: 13/240,949

(22) Filed: Sep. 22, 2011

(51) Int. Cl.
*G10D 3/12* (2006.01)

(52) U.S. Cl. ..... 84/303; 84/297 R

(58) Field of Classification Search ..... 84/297 S, 84/297 R, 290, 267, 303
See application file for complete search history.

(56) References Cited

U.S. PATENT DOCUMENTS

| | | | | |
|---|---|---|---|---|
| 6,784,353 | B1 | 8/2004 | Davis | |
| 6,815,596 | B2 * | 11/2004 | Goto | 84/304 |
| 7,332,662 | B2 | 2/2008 | Kandrack et al. | |
| 2007/0193430 | A1 | 8/2007 | Jang | |

* cited by examiner

*Primary Examiner* — Kimberly Lockett

(57) ABSTRACT

A spool mount for instrument strings that includes a housing mounted on an instrument, the housing having a plurality of spools disposed within, whereby each spool releasably unwinds a string when a locking button is depressed, and a length of string accordant with reaching an extant tuning key may be retrieved and unspooled therefrom to rapidly and easily replace a string on said instrument.

10 Claims, 4 Drawing Sheets

FIG. 1
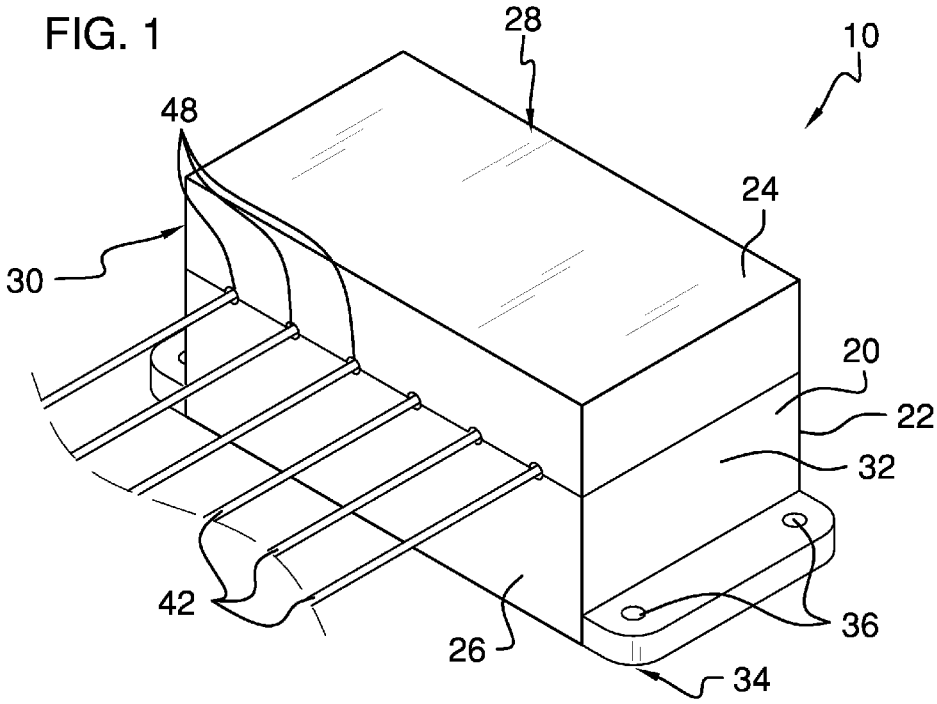
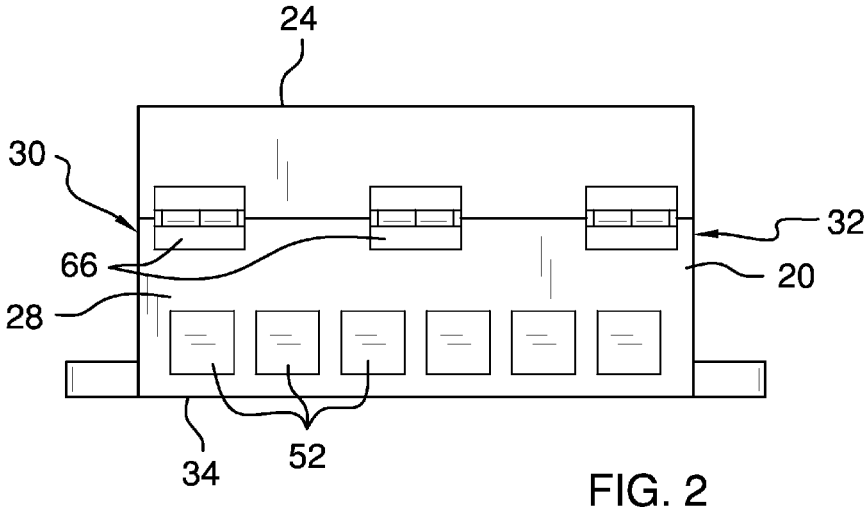
FIG. 2

SPOOL MOUNT FOR INSTRUMENT STRINGS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various devices are known in the prior art to hold strings taut on a stringed instrument. However, what is needed is a spool mount for instrument strings that includes a housing mounted on an instrument, the housing having a plurality of spools disposed within, whereby each spool releasably unwinds a string when a locking button is depressed, and a length of string accordant with reaching an extant tuning key may be retrieved and unspooled therefrom to rapidly and easily replace a string on said instrument.

FIELD OF THE INVENTION

The present invention relates to a mount for instrument strings, and more particularly, to a spool mount for instrument strings disposed on the body of a stringed instrument, wherefrom a length of string may be unspooled to replace a string easily and rapidly.

SUMMARY OF THE INVENTION

The general purpose of the spool mount for instrument strings, described subsequently in greater detail, is to provide a spool mount for instrument strings which has many novel features that result in a spool mount for instrument strings which is not anticipated, rendered obvious, suggested, or even implied by prior art, either alone or in combination thereof.

Broken strings are a common enough occurrence at rock concerts. It was on one such occasion, when my band was performing live, that our lead guitarist broke a string and the idea struck me that an easier, faster way to restring the guitar would be beneficial. Whereupon I did invent the present device disclosed in this specification.

Broken strings can impact the enjoyment of a concert by limiting the musical range playable on an instrument; by altering the sound of a tune recognizable to an audience; by requiring down time to replace the string, during which interval no music is played. A rapid, efficient way of changing strings could greatly improve a concert or musical performance where a string on an instrument is broken. Musicians everywhere, and especially musicians who play electric instruments to perform songs and music familiar as rock and roll, heavy metal, or other popular music, will greatly benefit from the present device.

Although the preferred embodiment of the present device as disclosed in this specification is presented in use with a guitar, it should be readily apparent that the present device can be used with any stringed instrument with only minor alterations in the size of the parts comprising the device. For clarity, however, the present device will be discussed as it may be applied to guitars, guitars being both more popular and more prone to broken strings than, say, a bass.

The present spool mount for instrument strings enables a rapid and simple way to restring a guitar, or other stringed instrument. Should a string break, the musician simply depresses a locking button, and pulls on the portion of the string connected to a spool disposed in a housing mounted onto the instrument. It is envisioned that a string with a greater length than the length of currently available strings is wound around said spool, and that when pulled, with the locking button depressed, the string will unwind from the spool, unspooling a length accordant with reaching the tuning key specific to said string, located at the instrument head. Thus the string may be rapidly restored to the instrument, rapidly tuned, and the resultant interruption in the performance minimized.

The instant spool mount for instrument strings includes a housing having a body and a lid. The lid is pivotally attached to the housing by a plurality of hinges disposed on a rear side of the body. A plurality of spools are disposed within the housing; in the preferred embodiment discussed in this specification, there are six spools, one for each string of the extant guitar to which the present device is mounted. The spools are mounted along an axle centrally disposed within the housing, the axle running parallel a front side, running from a left side to a right side of the housing. Each of the guitar strings is wound around each of the plurality of spools.

Each spool is capable of rotating, to unspool each string as desired. However, each spool is prevented from rotating until a particular locking button is depressed. There is a plurality of locking buttons disposed in a rear side of the housing, one button for each spool. Each of these buttons conjoins with a shaft, which shaft releasably engages with a locking gear, each locking gear disposed adjacent and adjoining each spool. When each button is depressed, each shaft moves toward the front side of the housing, disengaging with each locking gear to enable each spool to rotate, and each string to be unspooled, as desired. When each button is depressed, each shaft compresses each of a plurality of springs, each spring disposed so as to contact each shaft. When each button is released, each spring forces each shaft away from the housing front side to reengage each shaft with each locking gear to immobilize each spool and prevent rotation. Each string is thereby held taut within the present device.

The present device may be mounted to a front surface of a guitar (or other stringed instrument, if desired), or on the rear side of a guitar (or other stringed instrument) should such prove preferable.

The present device also enables an easier method of restringing and replacing old strings on an instrument. Each spool is simply replaced with a new spool, the new spool having a string already wound thereupon. It should be noted that the aforementioned axle upon which each spool is mounted within the housing is envisioned to be removable from within the housing and each spool simply slid therefrom. However, spools are envisioned that have an axle piece attached on either side of the spool surface where the string is wound, and that neighboring spools will interconnect. Furthermore, each spool may be individually secured in place within the housing by a fastening means.

Thus has been broadly outlined the more important features of the present spool mount for instrument strings so that the detailed description thereof that follows may be better understood and in order that the present contribution to the art may be better appreciated.

Objects of the present spool mount for instrument strings, along with various novel features that characterize the invention are particularly pointed out in the claims forming a part of this disclosure. For better understanding of the spool mount for instrument strings, its operating advantages and specific objects attained by its uses, refer to the accompanying drawings and description.

BRIEF DESCRIPTION OF THE DRAWINGS

Figures

FIG. 1 is a front isometric view.

FIG. 2 is a back isometric view.

DETAILED DESCRIPTION OF THE DRAWINGS

Figure 3:
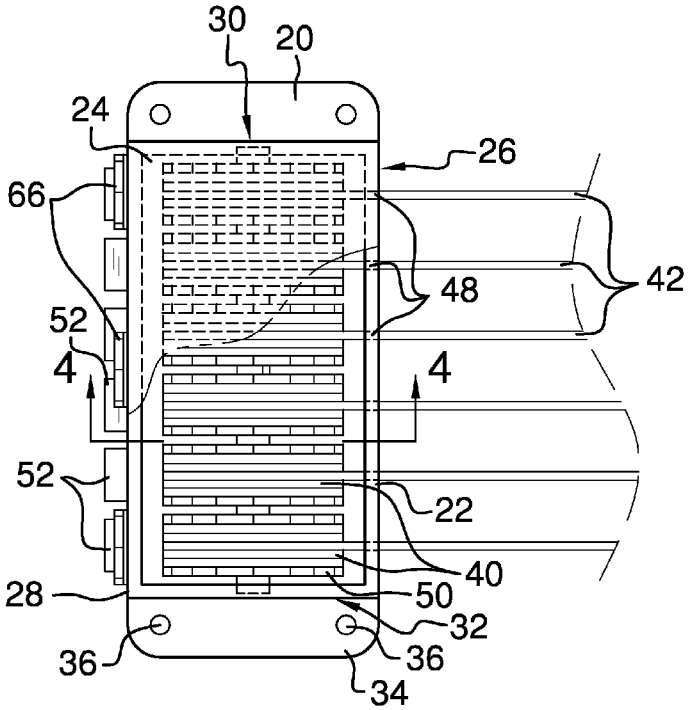
FIG. 3 is a top view.
Figure 4:
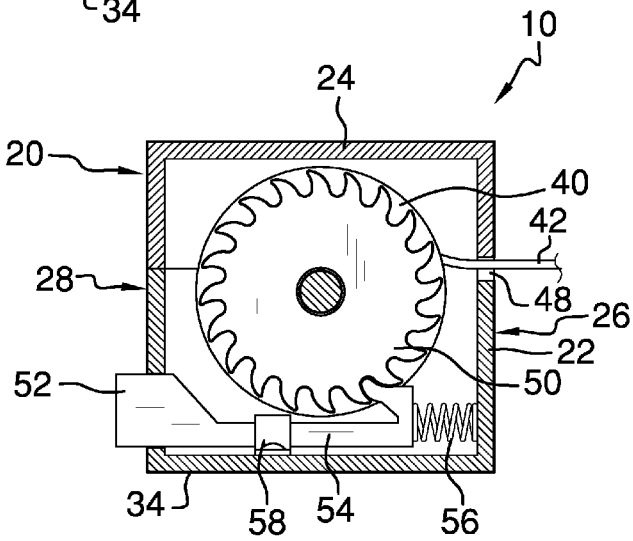
FIG. 4 is a cross section view taken along the line 4-4 of FIG. 3.
Figure 5:
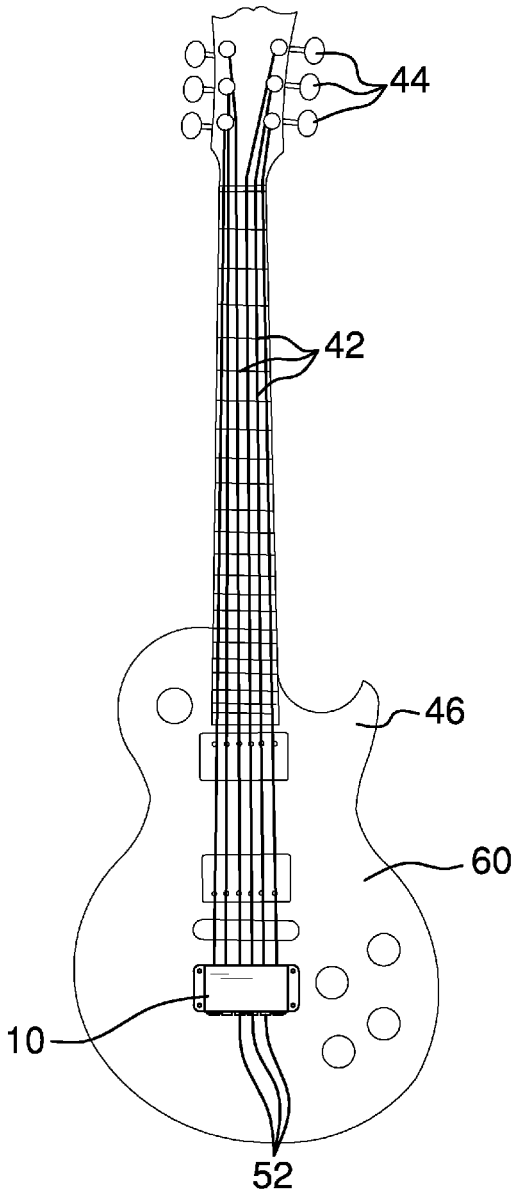
FIG. 5 is an in use view illustrating the device mounted to a front surface of a guitar.
Figure 6:
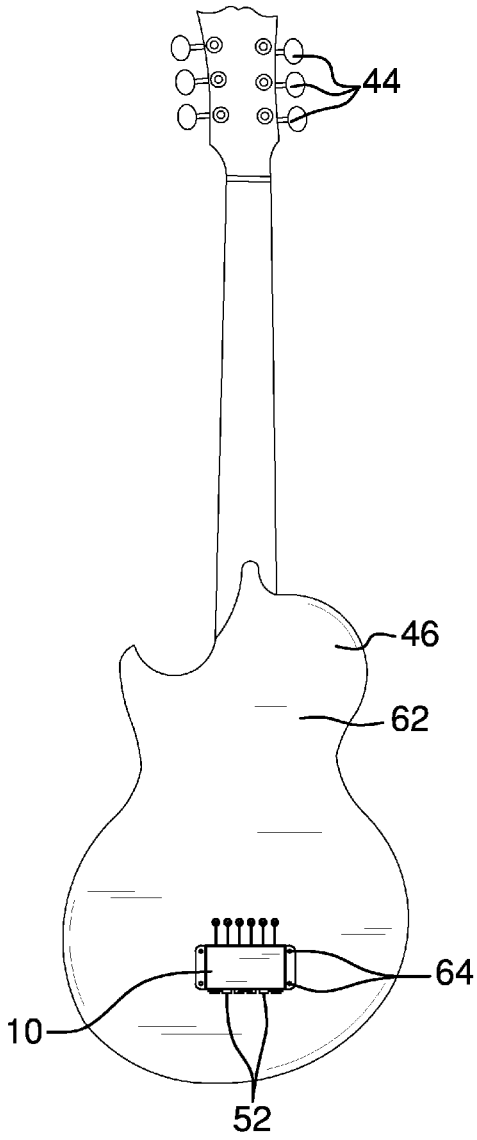
FIG. 6 is an in use view illustrating the device mounted to a rear surface of a guitar.

With reference now to the drawings, and in particular FIGS. 1 through 6 thereof, example of the instant spool mount for instrument strings employing the principles and concepts of the present spool mount for instrument strings and generally designated by the reference number 10 will be described.

Referring to FIGS. 1 through 6 a preferred embodiment of the present spool mount for instrument strings 10 is illustrated. It should be understood that although the present device 10 is illustrated in use with an electric guitar in this specification, such illustration is for example only. It is not intended that the present device 10 be limited to electric guitars only; clearly, it may be useable with any stringed instrument, as desired. However, for added clarity when discussing the device 10 and its components in this specification, the device is shown and discussed in use with a guitar 46 in this specification. Furthermore, as guitars remain popular instruments, and are perhaps more prone to broken strings than most other stringed instruments, a preferred embodiment of the device 10 is disclosed herein in use with a guitar 46.

The spool mount for instrument strings 10 includes a housing 20. The housing 20 includes a body 22 and a lid 24. The body has a front side 26, a rear side 28, a left side 30, a right side 32 and a base 34. In the preferred embodiment disclosed in this specification, the base 34 extends laterally outside the housing 20 left side 30 and the right side 32. A plurality of mounting holes 36 is disposed outside the housing 20 in the base 34.

The lid 24 is pivotally attached to the body 22 rear side 28 by a plurality of hinges 66. An axle 38 is centrally disposed within the body 22. The axle 38 is disposed between the left 30 and the right 32 sides parallel with the front 26 and the rear 28 sides.

A plurality of adjacent spools 40 is disposed along the axle 38. Each of the plurality of spools 40 is configured to wind a guitar string 42 thereupon, each string 42 thereby extending from each spool 40 to connect with the tuning keys 44 on an extant guitar 46.

A plurality of string apertures 48 is disposed in the front side 26 of the housing 20, each of said string apertures 48 configured to slidingly receive a guitar string 42 therethrough. Each of the string apertures 48 are disposed between the lid 24 and the housing 20 body 22 front side 26. Thusly, each of the string apertures 48 surrounds an extant guitar string 42 when the lid 24 is closed.

A plurality of locking gears 50 is disposed within the housing 20 adjacent and adjoining each of the plurality of spools 40. A plurality of locking buttons 52 is disposed in the housing 20 body 22 rear side 28, each of the plurality of locking buttons 52 connected to a shaft 54.

Each shaft 54 releasably engages with each of the locking gears 50 within the housing 20. Each spool 40 is thereby fixed from rotating, each locking button 52 shaft 54 engaging with each locking gear 50 until each locking button 52 is depressed and the locking gear 50 is henceforth released.

In the preferred embodiment disclosed in this specification, each shaft 54 is forced to engage with each locking gear 50 by means of a spring 56, said spring 56 disposed between each shaft 54 and the housing 20 front side 26, the spring 56 disposed proximal to the base 34. Each locking button 52 shaft 54 is secured parallel to the housing 20 base 34 and perpendicular the rear side 28 by means of a collar 58, each shaft 54 slidingly moveable along a single plane through said collar 58. Each shaft 54 therefore depresses each spring 56 when each button 52 is depressed, the collar 58 guiding the shaft 54 to depress said spring 56. When each button 52 is pushed, and each shaft 54 thereby moved to depress each spring 56, each shaft 54 disengages with each corresponding locking gear 50 and each spool 40 is enabled to rotate. Thusly, a musician (not shown) may depress a particular button 52 corresponding to a specific string 42, and pulling on said string 42, may unspool the string 42 from the corresponding spool 40. Thusly, if a string 42 is broken during a concert, a musician may simply depress a button 52, unspool more of said string 42 from within the housing 20, and reengage the string 42 to the particular tuning key 44, thereby lessening the time needed to restring the instrument 46 so that the concert or musical performance can continue quickly.

When each button 52 is released, each spring 56 exerts a force upon each shaft 54, forcing said shaft 54 away from the housing 20 front side 26, said shaft 54 engaging with each locking gear 50 to immobilize each spool 40. Therefore, when each button 52 is released, each shaft 54 is forced by each spring 56 to engage each locking gear 50 and each spool 40 is immobilized. Each guitar string 42 is thereby held taut when tightened at each corresponding tuning key 44.

The housing 20 is secured to an extant guitar 46 front surface 60 by means of a plurality of fasteners 64 removably inserted through the plurality of mounting holes 36. Alternatively, the housing 20 is secured to a extant guitar 46 back surface 62, if preferred, by means of the plurality of fasteners 64 removably inserted though the plurality of mounting holes 36.

It is also envisioned that each of the plurality of spools 40 may be removable from within the housing 20 and replaced with a spool 40 with a new string already wound thereupon. Each spool 40 is fittable to the axle 38, and removable therefrom when the housing 20 is opened. An alternative embodiment is envisioned wherein each spool 40 interconnects a piece of the axle 38, engaging each piece of the axle 38 with a neighboring spool 40, or, when so positioned, with the left 30 or right 32 side of the housing 20. Each spool 40 may also be individually removably secured within the housing, to be replaceable without necessitating removal of the plurality of spools 40 as may otherwise be required.

What is claimed is:

1. A spool mount for instrument strings comprising:

a housing having a body, the body comprising:

a front side;

a rear side;

a left side;

a right side;

a base;

a lid hingedly attached to the body;

an axle centrally disposed within the body, the axle disposed between the left and the right sides parallel with the front and the rear sides;

a plurality of adjacent spools disposed along the axle, each of the plurality of spools having an instrument string wound thereupon;

a plurality of string apertures disposed in the front side, each of said string apertures configured to slidingly receive an instrument string therethrough;

a plurality of locking gears, each of said locking gears adjoining each of the plurality of spools;

a plurality of locking buttons disposed in the housing rear side;

a plurality of shafts, each of said plurality of shafts conjoined with each of the plurality of locking buttons;

wherein each of the plurality of shafts releasably engages with each of the locking gears within the housing, whereby each spool is fixed from rotating by each shaft until each locking button is depressed and the locking gear is released.

2. The spool mount for instrument strings of claim 1 wherein each of the plurality of shafts is forced to engage with each locking gear by means of a spring.

3. The spool mount for instrument strings of claim 2 wherein each locking button shaft is secured parallel to the housing base and perpendicular the rear side by means of a collar, each shaft slidingly moveable along a single plane through said collar, wherein each shaft depresses a spring when each button is depressed.

4. The spool mount for instrument strings of claim 3 wherein each spool is configured to wind an instrument string thereupon, each string extending from each spool through each of the string apertures to connect with the tuning keys on an extant stringed instrument.

5. The spool mount for instrument strings of claim 4 wherein each of the plurality of spools is removable from within the housing and replaceable with a spool having a new string previously wound thereupon.

6. The spool mount for instrument strings of claim 5 wherein each of the string apertures are disposed between the lid and the hosing front side, wherein each of the string apertures surrounds an extant guitar string when the lid is closed.

7. The spool mount for instrument strings of claim 6 wherein the housing is secured to an extant guitar front surface by means of a plurality of fasteners removably inserted through a plurality of mounting holes.

8. The spool mount for instrument strings of claim 7 wherein the housing is secured to a extant guitar back surface by means of a plurality of fasteners removably inserted though a plurality of mounting holes.

9. The spool mount for instrument strings of claim 8 wherein the plurality of mounting holes are disposed through the housing base.

10. The spool mount for instrument strings of claim 9 wherein the base extends laterally outside the housing left side and the right side, said mounting holes disposed outside the housing.

* * * * *